United States Patent [19]

Vorie

[11] 4,246,447

[45] Jan. 20, 1981

[54] PIEZOELECTRIC TRANSDUCER DRIVE

[75] Inventor: Gilbert C. Vorie, Newark, N.Y.

[73] Assignee: IEC Electronics Corporation, Newark, N.Y.

[21] Appl. No.: 43,505

[22] Filed: May 29, 1979

Related U.S. Application Data

[63] Continuation-in-part of Ser. No. 923,080, Jul. 7, 1978, abandoned.

[51] Int. Cl.[3] ..... H04R 17/00

[52] U.S. Cl. ..... 179/110 A; 310/331

[58] Field of Search ..... 179/110 A, 110 F, 110 D, 179/110 R; 310/331, 332

[56] References Cited

U.S. PATENT DOCUMENTS

| | | | |
|---|---|---|---|
| 2,487,962 | 11/1949 | Arndt, Jr. | 179/110 A X |
| 3,222,462 | 12/1965 | Karmann et al. | 179/110 F |
| 3,749,855 | 7/1973 | Schafft | 179/110 F |

*Primary Examiner*—Thomas W. Brown

*Attorney, Agent, or Firm*—Hoffman Stone

[57] ABSTRACT

A stack of piezoelectric discs for driving the diaphragm of a transducer such as a loudspeaker. The discs are arranged in pairs with the outer edges of each pair supported by engagement with an O-ring against their planar faces. The pairs are connected by studs fixed at the centers of the discs. One end of the stack is secured to a support, and the other end is connected to the diaphragm. In an alternative embodiment, another disc is attached to the stack, with an O-ring cemented between its nodal circle and a rigid support, and a diaphragm is attached to the rim of the disc.

6 Claims, 4 Drawing Figures

PIEZOELECTRIC TRANSDUCER DRIVE

BRIEF DESCRIPTION

This application is a continuation in part of copending application of the same title, Ser. No. 923,080, filed July 7, 1978, assigned to the present assignee, and now abandoned.

This invention relates to transducers of the general kind described in U.S. Pat. No. 3,588,381, issued in 1971 to Hugo W. Schafft, and, more particularly, to the construction of stacks of piezoelectric members that constitute the drivers of the transducers.

The transducers described in the patent include stacks of bimorphs mounted in tandem and electrically driven to flex in opposition so that their deflections are additive to maximize the excursion at the output end of the stacks. The present invention contemplates a similar arrangement so far as operating principles are concerned, and is directed primarily to the means for mounting the piezoelectric members.

In the patented arrangement the bimorphs are mounted in a spacer device, shown as a cylinder with annular, inwardly facing grooves that receive the edges of the bimorphs and hold them against lengthwise displacement while allowing them to pivot as though on a hinge to minimize mechanical losses.

The arrangement is not easy to fabricate. In addition, it has been found that in operation, the transducers using it tend to develop unwanted output noises like buzzing or rattling, possibly due to a loosening of the clamping force of the space on the individual bimorphs.

In accordance with the invention, the piezoelectric members of each pair are not held in an edge clamp, but, instead, are held by facial engagement with an O-ring, being cemented to opposite sides of the O-ring or received in radially inwardly opening circumferential slits in it. This arragement has been found, surprisingly, to provide very satisfactory service over long periods of time, and it is also very easy to build.

A further feature of the invention contemplates a coaxial dual speaker arrangement in which only one of the drivers is mounted directly on a base support, the second driver being mounted upon the first one. The connection between the two drivers is along their nodal circles, providing a relatively large contact area to minimize localized stress in the cemented joints, and avoiding loading either of the drivers or affecting their resonance characteristics.

DETAILED DESCRIPTION:

Illustrative embodiments of the invention will now be described in conjunction with the drawings, wherein.

The transducers described herein include piezoelectric members of the kind known as unimorphs, instead of the bimorphs shown in the hereinabove identified patent. The difference, however, is immaterial. The bimorphs may be used interchangeably with the unimorphs, due allowance being made for their individual electrical and acoustical characteristics.

Figure 1:
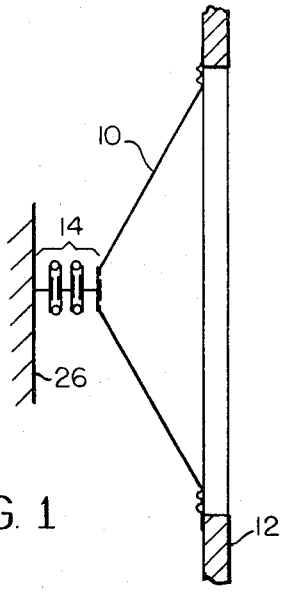
FIG. 1 is a side elevational view, partly in section of a transducer according to the invention.
Figure 2:
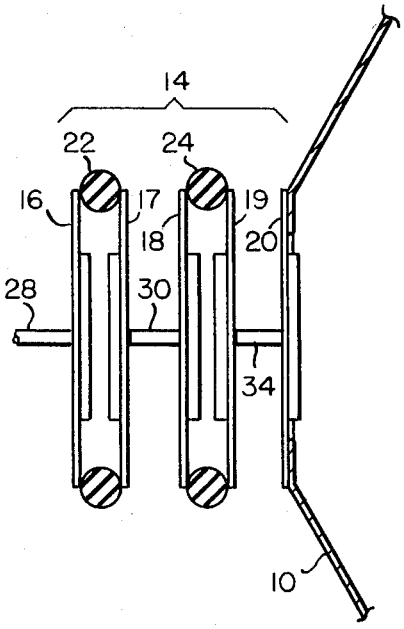
FIG. 2 is a side elevational view, partly in section, of the driver of the transducer shown in FIG. 1, showing it in greater detail.

Referring first to FIGS. 1 and 2, a woofer according to a first embodiment of the invention includes a conventianal diaphragm 10, which may be rim mounted as desired in an enclosure, only the outer wall 12 of which is indicated. The diaphragm is connected at its apex to a driver 14, which includes a stack of unimorphs 16, 17, 18, 19, and 20, respectively, shown in greater detail in FIG. 2. The first two unimorphs 16 and 17 are cemented on opposite sides of an O-ring 22, the mid diameter of which is approximately equal to the outer diameter of the unimorphs, so that, when viewed orthogonally in a direction normal to the planes of the unimorphs the radially outer half of the O-ring is visible extending radially beyond the unimorphs. The second pair of unimorphs 18 and 19 are similarly cemented to a second O-ring 24. The first pair 16 and 17 are rigidly secured by a centrally located stud 28 to a base support 26, which is rigid to the enclosure in which the transducer is mounted. The second pair 18 and 19 is fixed to the first pair by another central stud 30.

If desired, the diaphragm 10 may be secured to the center of the fourth unimorph 19, but to provide a larger bearing surface, the fifth unimorph 20 is preferably inserted in the array, being fixed to the fourth unimorph 19 by a central stud 34, and carrying the diaphragm around its rim.

Similarly to the teachings of the Schafft patent, electrical connections are made to the respective unimorphs so that their instantaneous deflections are additive and the excursion of the diaphragm produced in response to a signal of any given amplitude is maximized.

Figure 3:
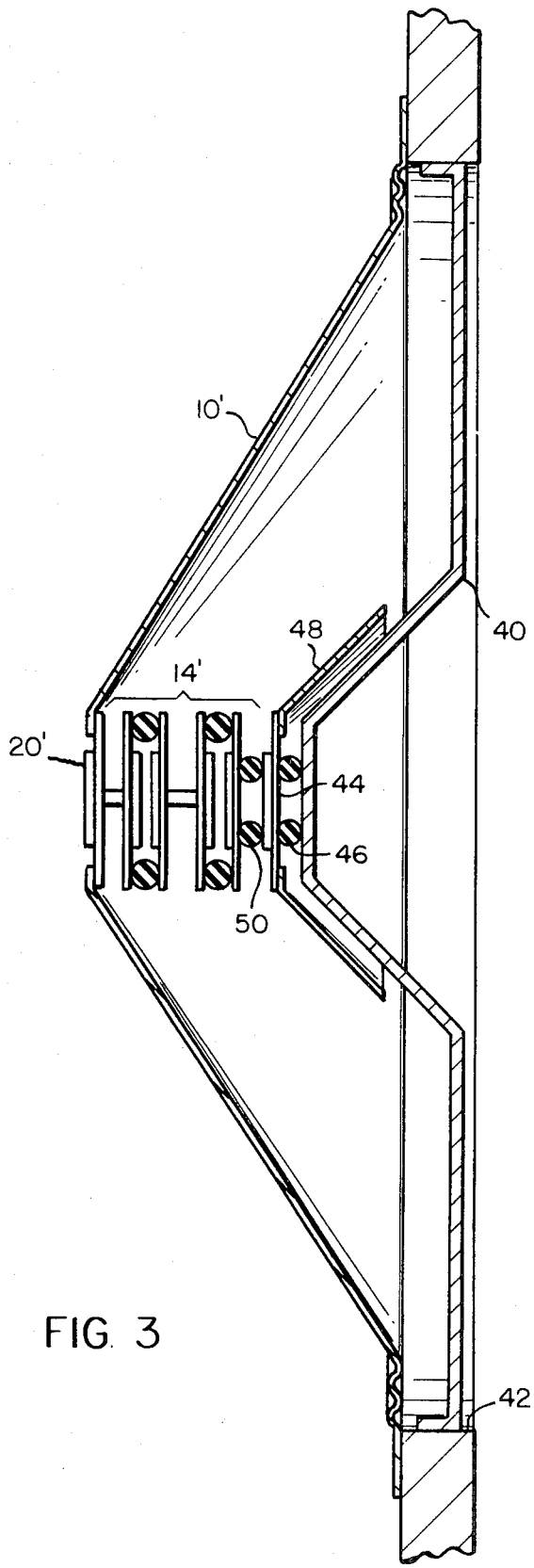
FIG. 3 is a side elevational view, partly in section, of a dual, coaxial speaker arrangement according to the presently preferred embodiment of the invention.

A coaxial arrangement according to the invention is shown in FIG. 3. In this embodiment the speaker is front mounted to a spider 40, which extends across the main speaker opening 42 in the speaker enclosure. A first unimorph 44 is cemented to an O-ring 46, the opposite side of which is cemented to the center of the spider 40. This O-ring 46 is smaller than the O-rings shown in FIGS. 1 and 2. Its mid diameter is selected to equal the diameter of the nodal circle of the unimorph, and it is cemeted to the unimorph along the nodal circle.

The mid-range speaker diaphragm 48 is cemented to the radially outer edge portion of the unimorph 44. A driver stack 14', which may be exactly similar to the stack 14 shown in FIGS. 1 and 2, is secured to the face of the unimorph 44 opposite from the spider 40 by another O-ring 50 cemented between the unimorph 44 and the stack 14' along their nodal circles. The woofer diaphragm 10' is cemented to the rearmost unimorph 20'.

Mounting the mid-range driver 44 by connection along its nodal circle provides relatively large area cement joints between the O-rings and the unimorph thereby limiting local stressing of the unimorph by the woofer driver 14' to values within the limits of its cohesive strength. Also, the arrangement avoids loading of the mid-range unimorph 44 and permits mounting of the woofer driver 14' through the mid-range unimorph without significantly affecting its frequency response characteristic.

If the mid-range speaker is to be driven over a frequency range including its resonant frequency, a bandstop filter of appropriate design is preferably included in the circuit used to drive it to achieve a so-called flat output characteristic.

Figure 4:
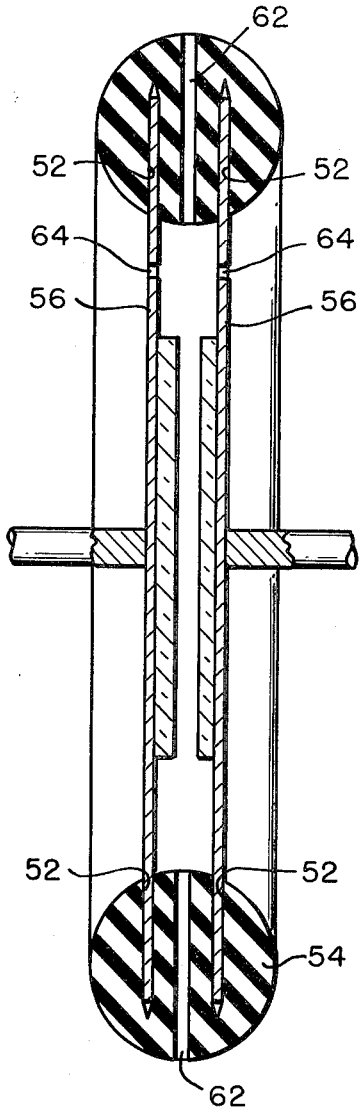
FIG. 4 is a cross sectional view on an enlarged scale relative to FIGS. 1—3 of an alternative mounting arrangement for securing the piezoelectric elements to an O-ring.

Instead of cementing the unimorphs to the O-rings, they may be secured in slits 52 cut in an O-ring 54 as shown in FIG. 4. The O-ring 54 should be a bit thicker than a common O-ring both to allow for relative axial motion between the unimorphs 56 and to provide adequate O-ring wall thickness on the outer faces of the unimorphs for firmly supporting them. In this case, as in the embodiments of FIGS. 1–3, the unimorphs are supported by contacts on their planar faces, not on their annular rims.

It is presently believed that the modified embodiment shown in FIG. 4 will be the preferred form of the invention for large scale production that will justify the cost of having especially thick O-rings made and slitted, and of the tooling needed for inserting the unimorphs.

It has also been found desirable to vent the O-rings in both forms of the mounting arrangement to reduce the resistance of air compression in the chambers formed by the O-rings and the unimorphs. In the embodiments of FIGS. 1–3, venting may be readily accomplished simply by cutting a short circumferential piece out of each O-ring leaving a gap 60 in it. In the embodiment of FIG. 4, one or more radial holes 62 may be punched through the O-ring, or axial perforations 64 may be cut in the unimorphs.

What is claimed is:

1. An electro-acoustical transducer comprising a pair of piezoelectric discs each of which in operation flexes in a cup-like mode, an O-ring slightly greater in over-all diameter than said discs, said discs being connected to each other by engagement of said O-ring on radially outer portions of their planar faces, means mounting one of said two discs to a reference support, a mechanicallly drivable acoustical member, and means mechanically connecting the other one of said two discs to said acoustical member for driving it.

2. An electro-acoustical transducer according to claim 1 wherein the connections between said discs and said O-ring are cement joints.

3. An electro-acoustical transducer according to claim 1 wherein said O-ring includes radially inwardly opening circumferential slits, and edge portions of said discs are received in said slits and secured thereby.

4. An electro-acoustical transducer comprising a pair of piezoelectric transducer discs each of which in operation flexes in a cup-like mode, an O-ring having a mid diameter approximately equal to the outer diameter of said discs, cement means securing said discs to opposite respective sides of said O-ring in coaxial alignment therewith, means connected to the center of one of said discs for rigidly mounting it upon a reference support, an acoustical diaphragm to be driven, and means connecting the rim portion of the other one of said discs to said diaphragm.

5. An electro-acoustical transducer comprising a first piezoelectric disc which in operation flexes in a cup-like mode and is characterized by a nodal circle spaced inwardly from its rim, a rigid reference support, an O-ring having a mid diameter equal to the nodal circle of said disc and cemented between the disc and the support in close alignment with the nodal circle, and a acoustical diaphragm to be driven connected to the rim of said disc.

6. A transducer according to claim 5 including a second piezo-electric disc similar to said first disc, a mechanically drivable acoustical element separate from said acoustical diaphragm, said element being connected to said second disc to be driven by it, and an O-ring cemented between said first and second discs in close alignment with both their nodal circles, whereby said discs may be driven independently of each other without significant cross-talk between them.

* * * * *